United States Patent [19]

Stohlquist et al.

[11] 4,388,795

[45] Jun. 21, 1983

[54] METHOD AND APPARATUS FOR FILLING CONTAINERS

[75] Inventors: Roger H. Stohlquist; Leo Strombeck, both of Rockford, Ill.

[73] Assignee: Anderson Bros. Mfg. Co., Rockford, Ill.

[21] Appl. No.: 189,625

[22] Filed: Sep. 22, 1980

[51] Int. Cl.[3] ..... A21C 15/04

[52] U.S. Cl. ..... 53/435; 53/276; 53/282; 53/518; 141/150; 141/280

[58] Field of Search ..... 53/266 R, 276, 282, 53/435, 518, 519, 313, 314; 141/150, 172, 280, 281, 283

[56] References Cited

U.S. PATENT DOCUMENTS

| | | | |
|---|---|---|---|
| 2,612,016 | 9/1952 | Anderson | 53/56 |
| 3,124,916 | 3/1964 | Anderson et al. | 53/37 |
| 3,172,435 | 3/1965 | Anderson et al. | 141/131 |
| 3,364,651 | 1/1968 | Stohlquist | 53/266 |
| 3,924,384 | 12/1975 | Kinney | 53/314 |
| 4,285,187 | 8/1981 | Schjeldahl | 53/282 |

*Primary Examiner*—W. D. Bray

*Attorney, Agent, or Firm*—Vernon J. Pillote

[57] ABSTRACT

A method and apparatus for filling open-top containers with a flowable semi-solid material in which the material is discharged in substantially continuous fashion to a downwardly opening nozzle. An empty container is elevated into partial telescoping relative with the nozzle and moves downwardly as it is filled. The filled container is moved crosswise of the nozzle and the vertical position of the container relative to the nozzle is controlled during movement crosswise of the nozzle to initially maintain the upper edge of the filled container below the lowre edge of the nozzle at its discharge side to shear off material at a level above the top of the container and to thereafter move the filled container upwardly sufficient to cause the trailing upper edge of the filled container to substantially wipe across the lower edge of the nozzle at the discharge side thereof.

16 Claims, 13 Drawing Figures

26
114
37
36
DS
21
21b
21a
X
X1
22
105a
102
24
105
102a
2
2
103
83
42
111
104
86
45
25
110
23
41
81
52
51
50
65
85
87
32
107
66
99
67
69
71
72
76
91
70
106
68
49
33
73
75
31
31
74
34

METHOD AND APPARATUS FOR FILLING CONTAINERS

BACKGROUND OF THE INVENTION

The present invention relates to a method and apparatus for filling containers wherein a flowable semi-solid material such as ice cream, sherbet or the like is discharged in generally continuous fashion through a downwardly opening nozzle into a container, and the container, when filled, is moved crosswise of the nozzle to shear the material in the container from the stream in the nozzle. Examples of such filling apparatus are shown in U.S. Pat. Nos. 2,612,016; 3,124,916; 3,172,435 and 3,364,651. Such filling apparatus use the container to measure the volume of material. However, this shearing action as the containers move crosswise of a nozzle tends to draw material away from the side of the container that leads during such movement and produce a material void in the container. When filling relatively flexible wall containers such as the rectangular paperboard containers shown in U.S. Pat. Nos. 2,612,016; 3,172,435 and 3,364,651, the container walls tend to bulge due to the product pressure and, during enfolding of the container flaps to close the carton, the carton tends to become more square and displace material into the product void. However, relatively rigid wall containers such as shown in U.S. Pat. No. 3,124,196, do not bulge during filling and eliminating the void at the top of the container has presented a continuing problem. In U.S. Pat. No. 3,124,916, the container is moved horizontally across the lower end of the nozzle and this produced an upper product line having a void at the lead side of the container and a bulge of material at the trail side of the container. U.S. Pat. No. 3,124,916 proposed to solve this problem by turning the container as it was moved from the filling station to a capping station so that the bulge of material would be at the lead side of the container and the cover would engage the bulge of material and press the same back into the container. While this tended to compensate for the void in the container, it frequently resulted in the discharge of some of the bulge of material over the side of the container, which discharged material not only resulted in an undesirable loss of product but also contaminated and defaced the outside of the container.

SUMMARY OF THE INVENTION

It is the object of the present invention to overcome the problems of the prior filling apparatus of the type in which containers are filled through a downwardly opening nozzle and then moved crosswise of the nozzle to shear off the material in the container from the material in the nozzle by controlling the relatively vertical position of the container and nozzle during movement of the container crosswise of the nozzle in a manner to initially shear off material at a level above the upper edge of the container and thereafter cause the trailing edge of the container to wipe across the lower edge of the nozzle to provide a clean cut-off of material. The added material in the container is then pressed back into the material void by the cover.

Accordingly, the present invention provides a method of filling containers with a flowable semi-solid material comprising, flowing a semi-solid material in continuous fashion through a downwardly opening nozzle, advancing an empty container to a filling station below the nozzle, elevating the container of the filling station into at least partially telescoping relation on the nozzle, lowering the container on the nozzle as it is filled, and moving the filled container along a filled container discharge path extending across a portion of the lower edge of the nozzle at one side thereof, the portion of the lower edge of the nozzle at said one side thereof defining a material shear edge for shearing the semi-solid material in the container from the material in the nozzle, characterized in that the container on the nozzle is first lowered to a position in which the upper edge of the container is spaced below at least a portion of the material shear edge on the nozzle at said one side of the nozzle, controlling the relative vertical position of the nozzle and container while the container is moved along the filled container discharge path to initially maintain the upper edge of the filled container below at least a portion of the material shear edge on the nozzle to shear off the material at a level above the top of the container and thereafter move the filled container and nozzle vertically toward each other sufficient to cause the trailing upper edge portion of the filled container to substantially wipe across the material shear edge on the nozzle at said one side thereof, and thereafter applying a cover onto the top of the filled container to press the material above the top of the container into the material void in the container.

The present invention also provides an apparatus for filling open-top containers with a flowable semi-solid material which comprises means including a downwardly opening nozzle for discharging a stream of semi-solid material in continuous fashion at a filling station, container transfer means for advancing an empty container to a position below the nozzle and for advancing a filled container from a position below the nozzle along the filled containers discharge path extending across a portion of the lower edge of the nozzle at one side thereof, the portion of the lower edge of the nozzle at said one side thereof defining a material shear edge for shearing the semi-solid material in a container from the material in the nozzle, container elevator means for elevating a container at the filling station into at least partial telescoping relation on the nozzle, container position sensing means for sensing when the container moves downwardly to a position in which the upper edge of the container is spaced below at least a portion of the material shear edge on the nozzle, means for controlling the vertical position of the filled container relative to the nozzle while the filled container is moved along the filled container discharge path and operative to initially maintain the upper edge of the filled container at a level below at least a portion of the material shear edge on the nozzle to shear off material at a level above the upper edge of the container and to thereafter raise the filled container sufficient to cause the trailing upper edge of the filled container to substantially wipe across the material shear edge on the nozzle at said one side thereof, and thereafter pressing a cover down onto the open-top of the filled container to press the added material into the material void in the top of the container.

These, together with other objects and advantages of this invention will be more readily understood by reference to the following detailed description, when taken in connection with the accompanying drawings wherein.

Figure 1:
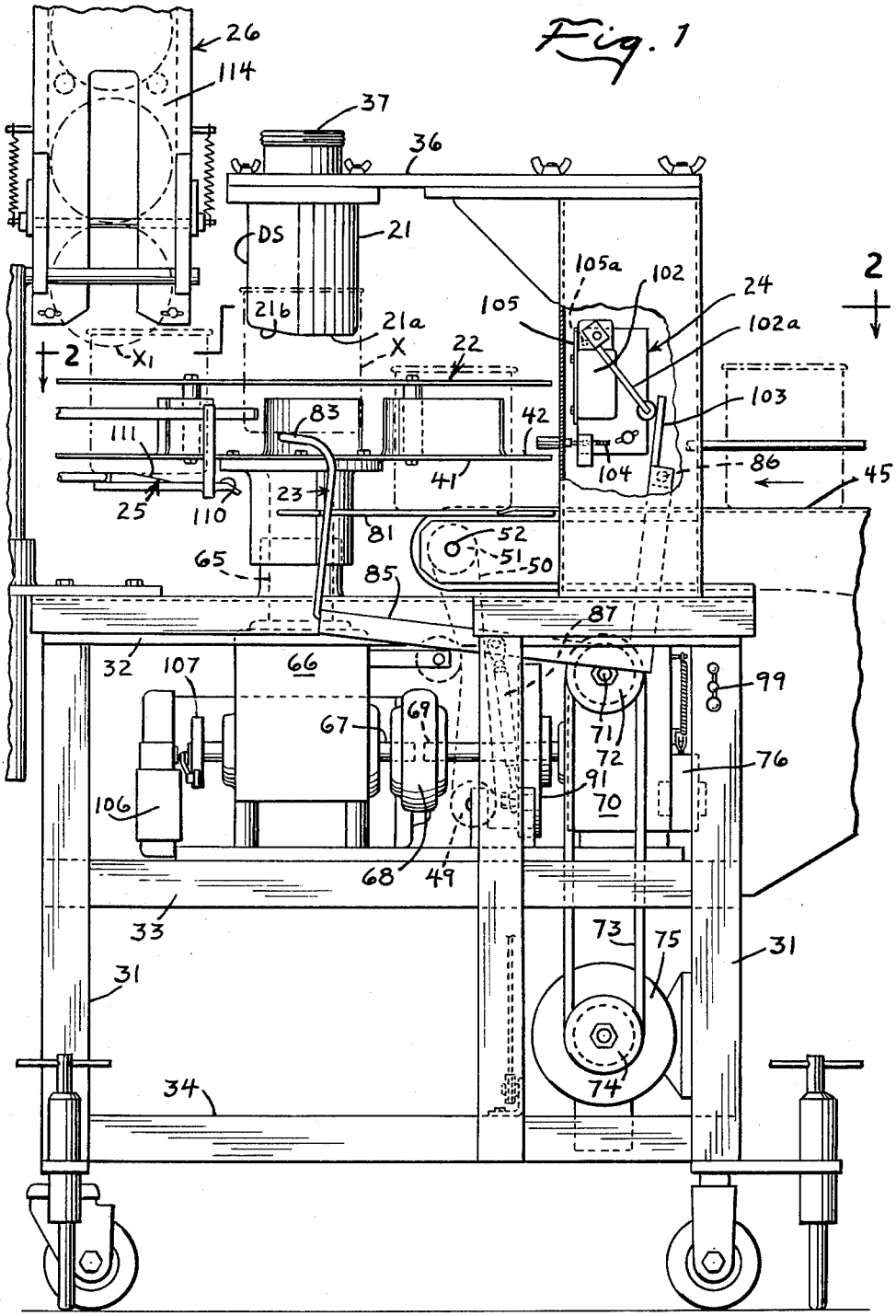
FIG. 1 is a front elevationa view of a filling apparatus embodying the present invention.
Figure 2:
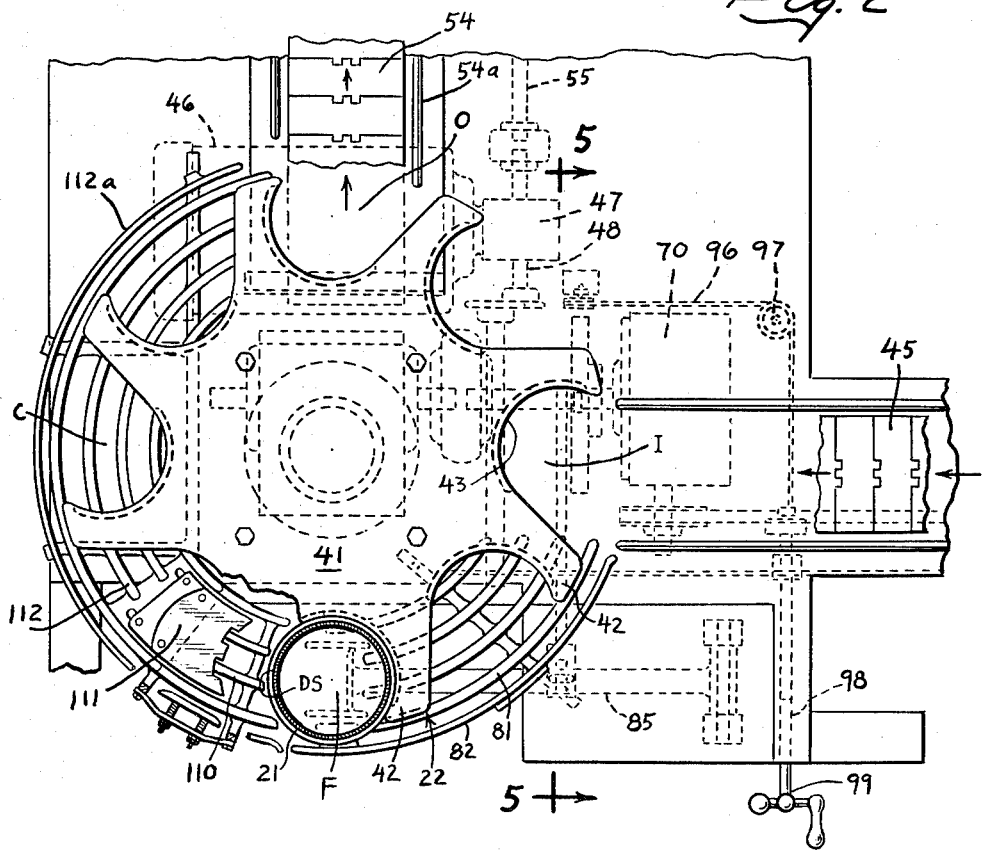
FIG. 2 is a fragmentary top plan view of the filling apparatus of FIG. 1.
Figure 3:
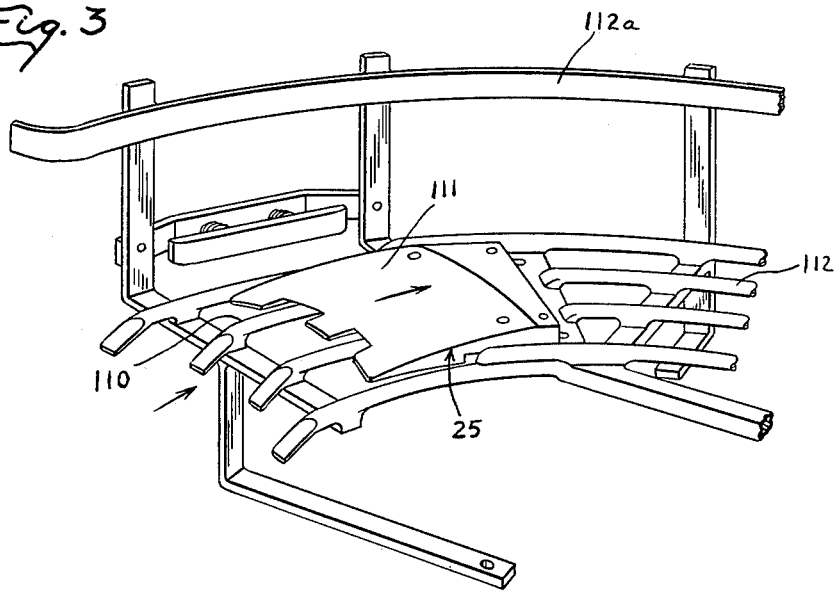
FIG. 3 is a fragmentary perspective view illustrating parts on a larger scale than FIG. 2.
Figure 4:
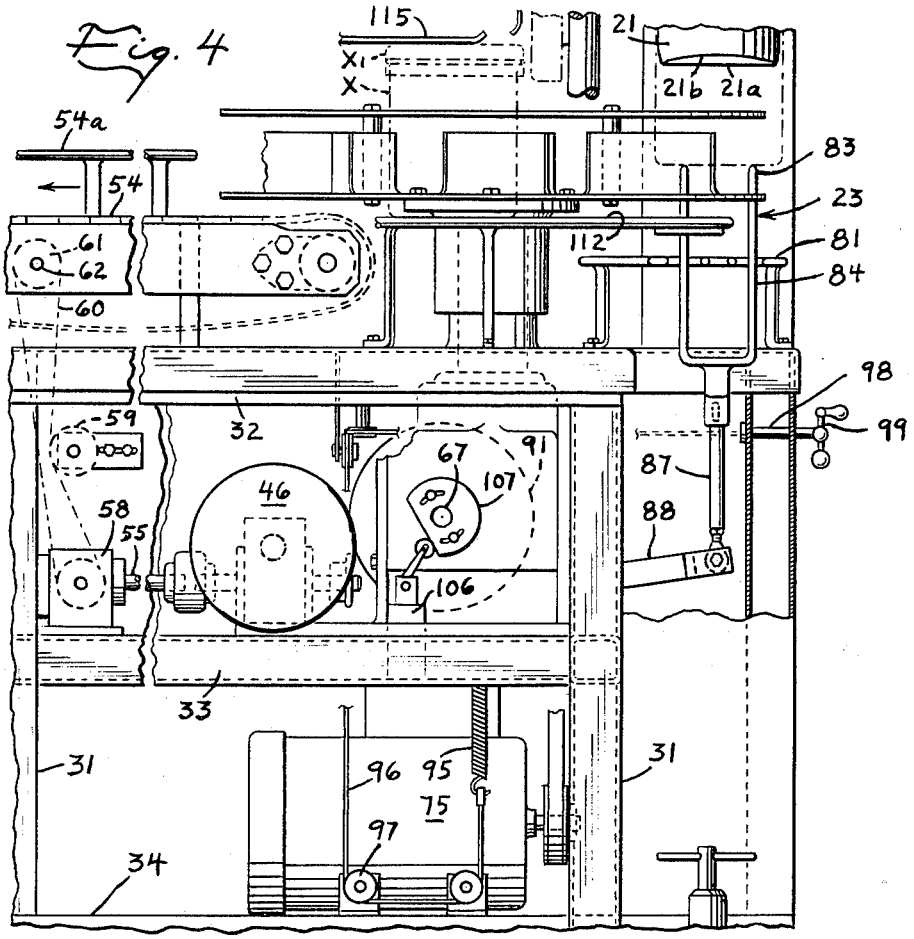
FIG. 4 is a fragmentary end elevational view of the filling apparatus, with parts broken away and shown in section to illustrate details of construction.

The present invention relates to an improved method and apparatus for filling containers in which a flowable semi-solid material such as soft ice cream, sherbert and the like is discharged through a downwardly opening nozzle into a container and the filled container then moved crosswise of the nozzle to shear off the material in the container from the material in the nozzle. Movement of the container crosswise of the nozzle tends to produce a material void adjacent the lead side of the container and the refilling of this void has presented a particular problem in containers having relatively rigid walls that do not distend significantly under the product pressure encountered during the filling. Some containers such as the cylindrical and frusto-conical walled tubs or containers that are sometimes used in the packaging of ice cream, sherbet and the like, have relatively rigid walls that do not bulge significantly during filling and are examples of containers that can be advantageously filled by the method and apparatus of the present invention. Cylindrical walled containers are diagrammatically illustrated in the drawings and designated generally by the letter X and have a bottom wall, a generally cylindrical side wall open at the top and a rim on the upper edge of the side wall. Flanged covers X1 are commonly used for closing such cylindrical walled containers. It is contemplated that the method and apparatus of the present invention can also be used for filling containers of other shapes and cross-sectional configurations.

One embodiment of the filling and capping apparatus suitable for practicing the present invention is illustrated in FIGS. 1–9. The filling apparatus in general includes a downwardly opening nozzle 21 for discharging a stream of semi-solid material in generally continuous fashion, a container transfer mechanism 22 for advancing empty containers to a position below the nozzle and for advancing a filled container from a position below the nozzle along a filled container discharge path extending across a portion of the lower edge of the nozzle at the outlet side thereof to separate the semi-solid material in the container from the material in the nozzle, container elevator means 23 for elevating a container at the filling station into at least partial telescoping relation on the nozzle, container position sensing means 24 for sensing when the container on the nozzle moves downwardly to a preselected position, a means 25 for controlling the vertical position of the container relative to the nozzle while the filled container is moved along the container discharge path and which is operative to initially maintain the upper edge of the filled container at a level below the lower edge of the nozzle at the outlet side thereof to shear off said material at a level above the upper edge of the container and to thereafter move the filled container vertically toward the nozzle sufficient to cause the trailing upper edge of the filled container to substantially wipe across the lower edge of the nozzle. A capping apparatus 26 is provided for pressing a cover onto the open top of the filled container.

The filling apparatus is mounted on a frame structure including a plurality of upright supports 31 and upper, intermediate and lower frame members 32, 33, and 34 that are connected to the upright frame members. The nozzle 21 is rigidly mounted as by uprights 35 and horizontally disposed plate 36 on the support frame to extend downwardly above a filling station. Semi-solid material, for example ice cream, sherbet or the like, is supplied to the nozzle from a suitable source such as a continuous type freezing apparatus (not shown) through a conduit connected to a fitting 37 on the top of the nozzle. The nozzle 21 has a cross-sectional configuration corresponding generally in the cross-sectional configuration to that of the container X to be filled, but is sufficiently smaller to allow the container to be moved into telescoping relation thereon, and the lower end of the nozzle is tapered inwardly to facilitate guidance of the container into telescoping relation on the nozzle. As shown, the nozzle 21 has a round cross section for use in filling cylindrical containers of round cross section.

The container transfer mechanism 22 is herein shown in the form of a star wheel 41 having a plurality of outwardly extending arm 42 at angularly spaced locations therearound defining container receiver pockets 43 between adjacent arms. The container transfer mechanism is intermittently operated to advance containers from a container inlet station I sequentially past the filling station F and capping station C to the outlet station O. An inlet conveyor 45 is provided for feeding empty containers to the inlet station and may, for example, be of the endless type which extends generally radially of the star wheel at the inlet station I. The inlet conveyor 45 may be driven in continuous fashion from a conveyor drive motor 46 through a right angle drive 47 having an output shaft 48. The output shaft 48 is connected as through a sprocket 49, chain 50 and sprocket 51 to a shaft 52 on the inlet conveyor. The conveyor 45 advances the empty container into a star wheel pocket 43 at the infeed station I and the conveyor is formed with a sufficiently smooth surface to slip underneath the containers when the advance of the containers is interrupted by engagement with the star wheel. An outlet conveyor 54 extends generally radially of the star wheel at the outlet station O and is also conveniently driven in continuous fashion from the conveyor drive motor 46 through a shaft 55 connected to the output shaft 48 of the right angle drive, through a second right angle drive 58, sprocket 59, chain 60 and sprocket 61 to a shaft 62 on outlet conveyor 54. The outlet conveyor 54 is driven in the direction indicated by the arrow in FIG. 2 to move the filled and capped containers away from the outlet station O and lateral container guides 54*a* are provided along opposite sides of the outlet conveyor.

The star wheel is drivingly connected to the vertical output shaft 65 of a right angle index drive 66 having an input shaft 67 extending therethrough and which is operative, when the input shaft is rotated through one revolution, to index the star wheel a distance corresponding to the spacing or pitch of adjacent pockets on the star wheel. As best shown in FIG. 1, the shaft 67 of the index drive 66 is connected through a coupling 68 to the output shaft 69 of a one revolution clutch 70, and the input shaft 71 of the one revolution clutch is connected through a pulley 72, belt 73 and pulley 74 to a drive motor 75. The one revolution clutch 70 has an electrically operated actuator 76 which is operative, when actuated, to trip the clutch 70 and drive the output shaft 69 through one revolution.

The containers X are supported on container support rails 81 and guided by lateral guide rails 82 as they are advanced by the star wheel from the container infeed station I to the filling station F. The support rails 81 are spaced below the lower end of the nozzle 21 a distance somewhat greater than the height of the container so as to avoid interference with the material as it continuously emerges from the nozzle, and the container elevator mechanism 23 is operated in timed relation with the container transfer mechanism to elevate the empty container into at least partial telescoping relation with the nozzle as shown in FIG. 1.

Figure 5:
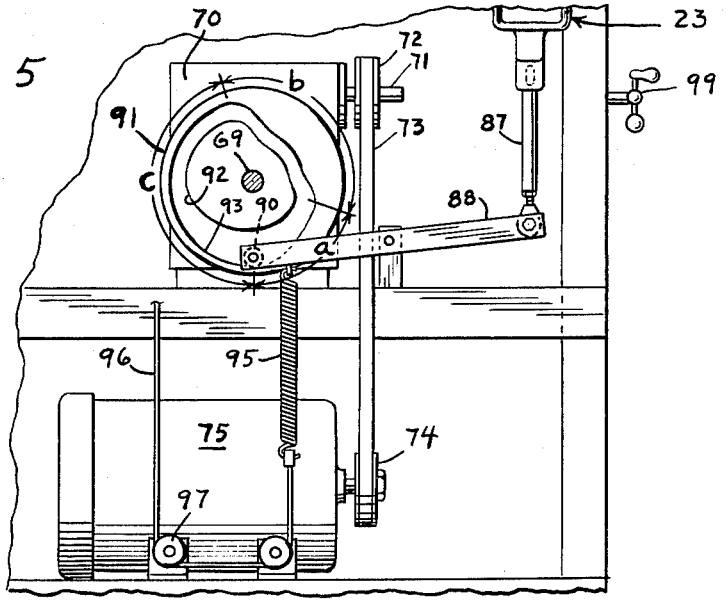
FIG. 5 is a fragmentary vertical sectional view taken on the plane 5—5 of FIG. 2 illustrating the container elevator drive.
Figure 6:
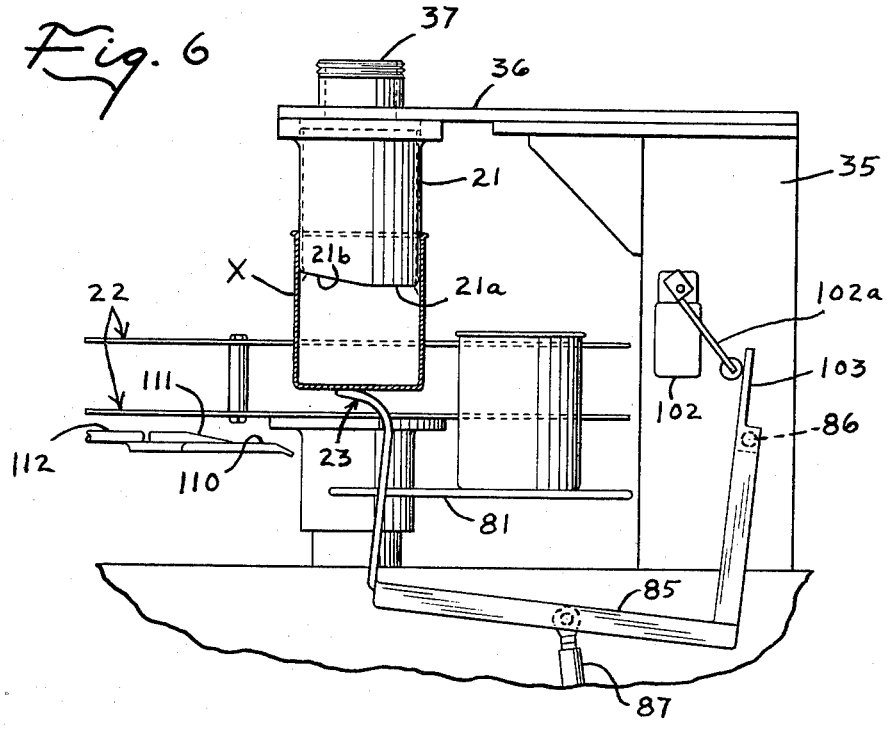
FIGS. 6, 7, 8 and 9 are diagrammatic views illustrating different steps in the filling and shearing of the material in the container from the material in the nozzle.

The container elevator mechanism 23 includes spaced container engaging fingers 83 on the upper ends of spaced support posts 84 that are arranged to move upwardly between the container support rails 81 at the filling station F to engage the underside of the container and elevate the same into telescoping relation with the nozzle. The fingers 83 are supported for vertical movement, and as best shown in FIG. 1, are mounted on the end of a generally L-shaped lever 85 that is pivoted at 86 on the upright 35. A link 87 has one end pivotally connected by a universal ball type pivot to the lever 85 intermediate its ends and the other end of the link 87 is pivotally connected through a universal ball type pivot to one end of a lever 88 (FIG. 5) that is pivoted intermediate its ends at 89 on the support frame. A cam follower 90 at the other end of the lever 88 engages a cam 91 on the output shaft 69 of the one revolution clutch. Provision is made for counterbalancing the elevator and the container and product therein so that the container can move downwardly as it is filled under the weight and pressure on the product in the container. As shown in FIG. 5, a coil type tension spring 95 has one end connected to the lever 88 and the other end connected through a cable 96 entrained over pulleys 97 and connected to an adjusting screw 98 operated from a crank 99. Crank 99 is manually adjustable to vary the tension of spring 95 in a manner to control downward movement of the container on the elevator in response to the weight and pressure on the product in the container.

The cam 91 is shown in FIG. 5 in the stop position of the output shaft 69 of the one revolution clutch 70. The cam has inner and outer cam surfaces 92 and 93 for engaging the cam follower 90 to control movement of the elevator. The inner cam surface 92 is shaped to control the lowermost position that the elevator can assume in the different rotated positions of the cam and the outer cam surface 93 is shaped to control the uppermost position that the elevator can assume in the different rotated positions of the cam. In general, the inner and outer cam surfaces are shaped and arranged to positively move the elevator 23 downwardly as the cam sector a moves past the cam follower 90 to thereby allow an empty container on support rails 81 to advance into position below the nozzle at the filling station F while a filled container is advanced away from the filling station. The inner and outer cam surfaces are shaped and arranged to thereafter positively and rapidly move the elevator to a raised position to elevate the empty container into partial telescoping relation on the nozzle, as the cam sector b moves past the cam follower 90. The inner and outer cam surfaces are arranged in the sector c of the cam so as to effectively disengage the follower 90 and allow the elevator 23 to move downwardly as the weight and pressure on the product in the containers overcome the bias of the spring 95. When the elevator 23 moves down to a preselected lower position, it actuates the container position sensing means 24 and starts another machine cycle.

The container position sensing means 24 comprises a switch 102 having an actuator **102*a* positioned to engage a finger 103 on the elevator support lever 85. The switch 102 is normally open and is arranged to be closed when the elevator 23 reaches a preselected lower position and the switch 102 is electrically connected to the electrically operated actuator 76 for the one revolution clutch to operate the clutch when the switch 102 is closed. In order to adjust the position of the elevator at which the switch is actuated, the switch 102 is mounted on a bracket 105 for limited pivotal adjustment about an axis 105*a* and a means such as adjusting screw 104 is provided for adjustably pivoting the switch bracket 105 to control the position at which the elevator operates the switch. A normally closed cam switch 106 (FIG. 4) is connected in series with the container positioning sensing switch 102 and is operated from a cam 107 on the shaft 67 of the index drive 66. Cam 107 allows the cam switch 106 to close when the shaft 67 is in its normal stop position shown in FIG. 4 and the cam is arranged to open the cam switch to prevent a repeat actuation of the clutch actuator 76 by the position sensing switch 102**, until after the clutch has completed one revolution.

Figure 7:
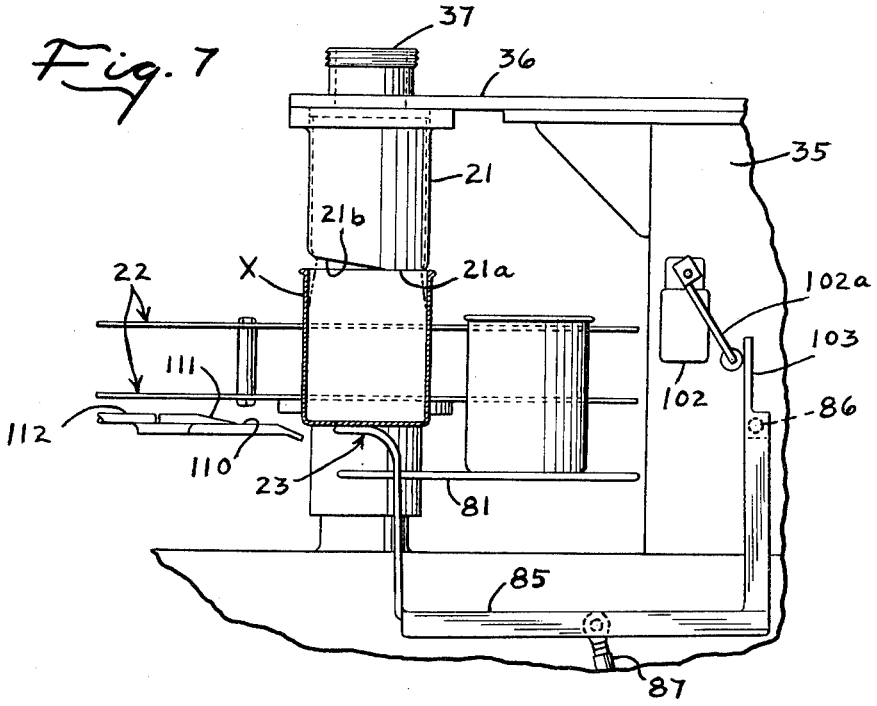
Figure 8:
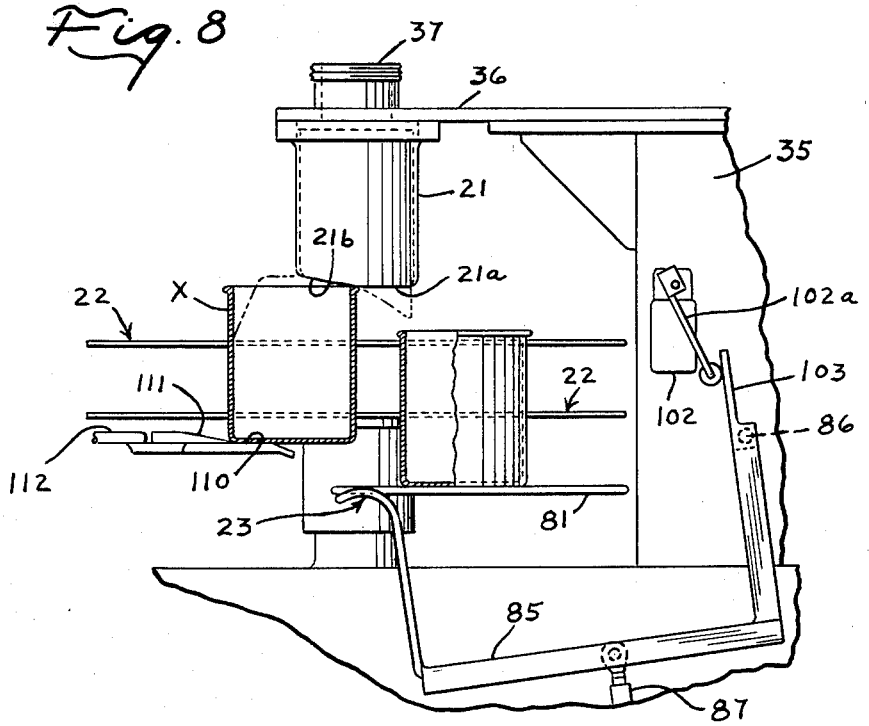

The conveyor transfer mechanism operates when actuated to move a filled container from a position below the nozzle along a path that extends crosswise of one side of the nozzle, herein sometimes referred to as discharge side of the nozzle and designated DS. The portion of lower edge of the nozzle that extends crosswise of the path of movement of the container at the discharge side of the nozzle, defines a material shear edge which controls the level at which the product in the container is sheared from the product in the nozzle during movement of the container along the discharge path. In the cylindrical nozzle illustrated, the material shear edge is defined by the semi-circular lower edge portion at the discharge side of the nozzle. Movement of the container crosswise of the nozzle tends to produce a material void in the top of the container adjacent the lead side of the container. In accordance with the present invention, the relative vertical position of the nozzle and container is controlled while the container is moved along the container discharge path in such a manner as to initially maintain the upper edge of the filled container spaced below at least a portion of the material shear edge on the nozzle to shear off material at a level above the top of the container and to thereafter move the filled container and nozzle vertically toward each other sufficient to cause the trailing upper edge of the filled container to substantially wipe across the material shear edge on the nozzle at its discharge side, to produce a relatively sharp cut-off of material. Some advantages of this invention can be realized utilizing a nozzle whose entire lower edge is disposed in a horizontal plane. However, improved cut-off of material is achieved by modifying the lower edge of the nozzle to provide one lower edge portion 21*a* at the side of the nozzle remote from the discharge side that is disposed in a horizontal plane and a second lower edge portion 21*b* at the discharge side of the nozzle that is inclined upwardly from that horizontal plane in the direction of movement of the container along its discharge path. As previously described, the semi-circular lower edge portion at the discharge side of the nozzle defines the material shear edge. In the embodiment illustrated, the inclined second lower edge portion 21*b* is substantially coextensive with the material shear edge, it being understood that the inclined portion 21*b* could extend along only a portion of the material shear edge, if desired. The container at the nozzle is allowed to move downwardly as it is filled until the upper edge of the container is at a level adjacent the first lower edge portion 21*a* of the nozzle and spaced below the second lower edge portion 21*b* as shown in FIG. 7. The conveyor transfer mechanism is then actuated to move the filled container crosswise of the nozzle with the upper edge of the filled container at a level below the lower edge portion 21*b* of the nozzle to shear off material in the container at a level above the upper edge thereof as shown in phantom lines in FIG. 8. When the trailing edge of the container reaches the lower edge portion 21*b*, the container is thereafter progressively raised during advance along the discharge path sufficient to cause the trailing upper edge portion of the filled container to substantially wipe across the lower edge portion 21*b* of the nozzle. This provides a sharp cut-off of the material in the container from the material in the nozzle, as shown in phantom lines in FIG. 9. In the embodiments of FIGS. 2–9, the container is supported during movement along the discharge path by a container support having a generally horizontal container support portion 110 that underlies and supports the container with its upper edge adjacent the level of the lower edge portion 21*a* of the nozzle, while the container moves from the position below the nozzle to a position as shown in FIG. 8 and an inclined ramp portion 111 that is inclined upwardly from the horizontal container support portion 110 in the direction of travel of the container to progressively raise the container at a rate such as to cause the trailing edge portion of the container to substantially wipe across the lower edge portion 21*b* of the nozzle. As will be understood, the incline of the lower edge portion 21*b* of the nozzle and the incline of the ramp are correlated with each other to cause the trailing edge of the container to substantially wipe across the inclined lower edge portion 21*b* of the nozzle. The containers are supported on generally horizontal container support rails 112 as they move from the filling station past the capping station to the outlet station, and a circumferential guide rail 112*a* is provided for guiding the containers around the star wheel.

Figure 9:
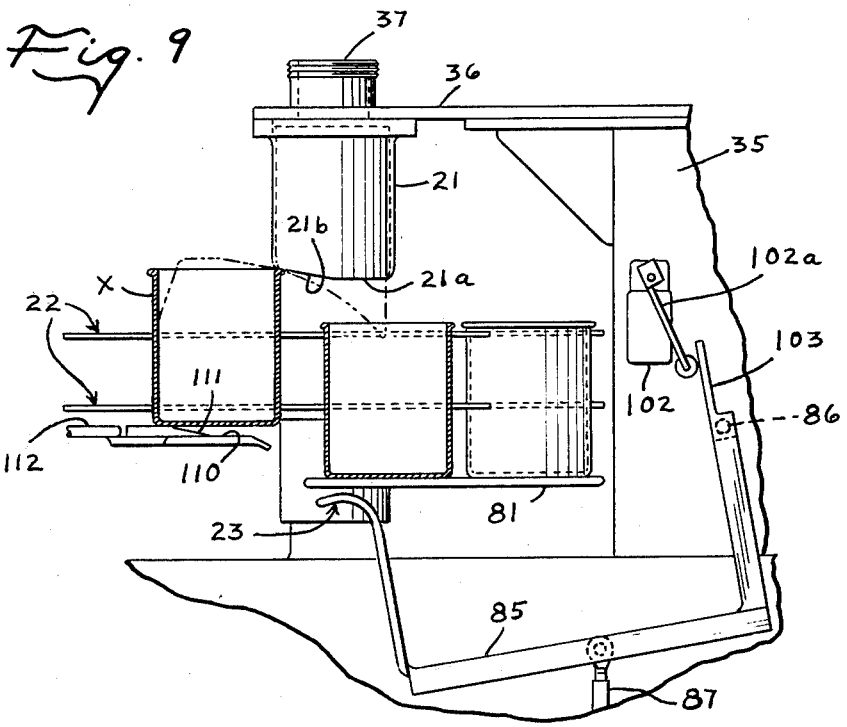
Figure 13:
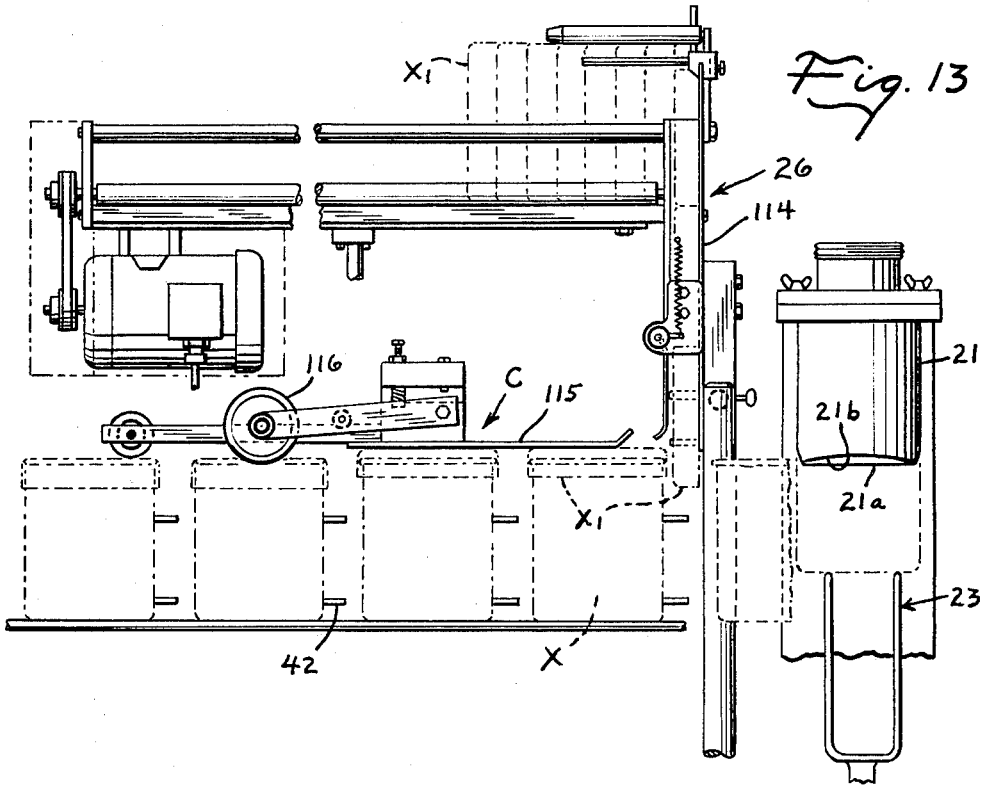
FIG. 13 is a diagrammatic view illustrating capping of the container.

A cover X1 is thereafter applied to the filled container by the cover applying mechanism 26. Flanged covers are commonly used for covering cylindrical containers of the type shown in the drawings and any suitable cover applying mechanism can be utilized. The cover, when pressed down onto the container, presses the additional material in the container into the void and provides a substantially filled container. As shown in FIGS. 9 and 13, the cover applying mechanism includes a cover guide 114 that supports the lowermost cover X1 with its lower edge in the path of movement of the upper edge of the container as the container is advanced by the container transfer mechanism past the capping station C and a means for pressing the cover down onto the container as it is moved past the cover applying mechanism. As shown, this includes a pressure plate 115 and a pressure applying roller 116.

Figure 11:
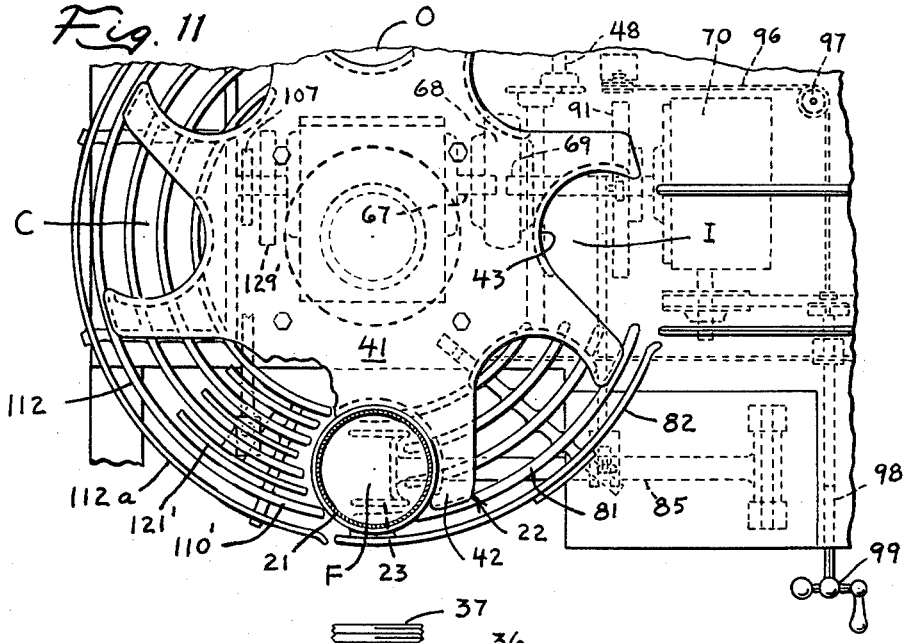
FIG. 11 is a fragmentary top view of the apparatus of FIG. 10.
Figure 10:
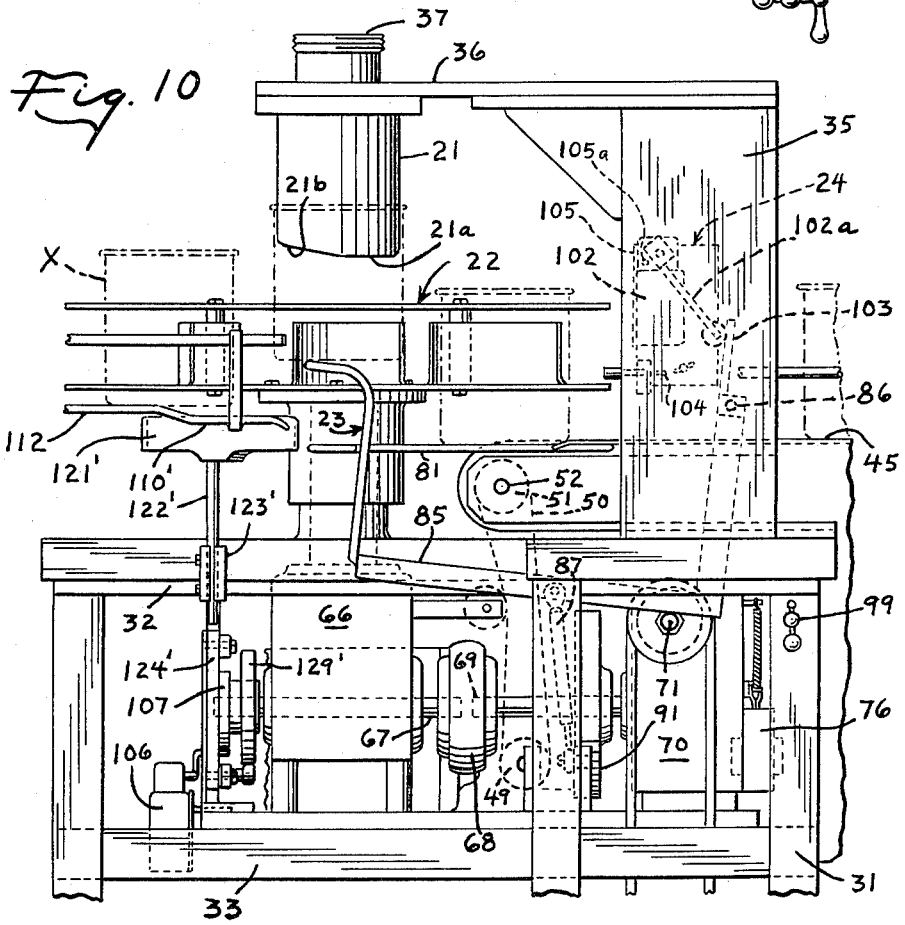
FIG. 10 is a fragmentary front view of a modified form of apparatus for filling containers.
Figure 12:
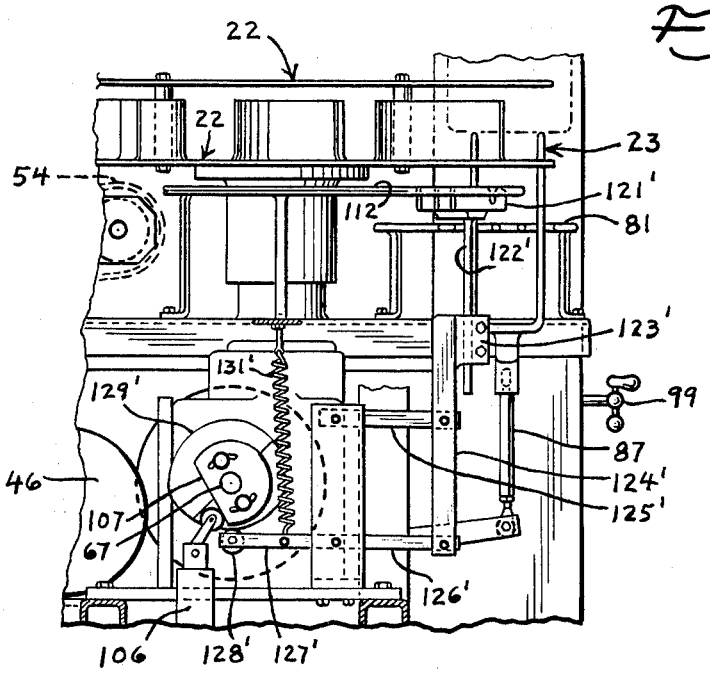
FIG. 12 is an end elevational view of the filling apparatus of FIG. 10.

When filling containers which are very short as compared to their cross-sectional dimension, some problems are encountered in maintaining the container upright during movement along the ramp 111. FIGS. 10–12 illustrate the presently preferred mechanism for controlling the vertical position of the container relative to the lower edge of the nozzle during movement of the filled container crosswise of the nozzle. The filling mechanism of FIGS. 10–12 is generally the same as that described in connection with FIGS. 1–9 and like numerals are used to designate corresponding parts and numerals with the suffix ′ are used to designate modified parts. In this embodiment, a container support 110′ is provided adjacent the outlet of a nozzle at a level spaced below the lower edge portion 21*a* a distance only slightly greater than the height of the container. A second elevator mechanism 121′ is provided for raising the container as it is moved crosswise of the nozzle. As shown, the second elevator mechanism includes spaced support bars that are movable between the support rails 110′, and which support bars are attached to the upper end of a post 122′ that is adjustably mounted at 123′ on the elevator support 124′. The elevator support is supported for limited vertical movement by parallelogram linkages including an upper link 125′ and a lower link 126′. The lower link 126′ is extended to provide an arm 127′ having a follower 128′ that engages a cam 129′ on the shaft 67. As previously described, the shaft is rotated through one revolution in timed relation with the indexing of the container transfer mechanism and the cam is shaped to commence lifting of the container after its trailing edge has reached a position adjacent the lower edge portion 21*b* of the nozzle and the raising of the container is controlled by the cam so that the trailing edge of the container is disposed in substantial wiping contact with the lower edge portion 21*b* as the container moves along its discharge path. The elevator 121′ provides improved support for the container and maintains the container generally upright while raising the container during movement along its discharge path. A coil type tension spring 131′ is connected to the arm 127′ and to the frame to maintain the follower 128′ in engagement with the cam 129′.

From the foregoing it is thought that the practice of the method and the construction and operation of the ayparatus will be readily understood. The container transfer mechanism operates to intermittently advance empty containers from the container infeed station I to the filling station F at a level below the nozzle 21, and the container transfer mechanism also operates to intermittently advance filled containers from a position below the nozzle along a container discharge path crosswise of the nozzle past a capping station C to the container outlet station O where they are removed by the outlet conveyor. The container elevator mechanism is operated in timed relation with the operation of the container transfer mechanism to elevate an empty container into partial telescoping relation with the nozzle.

The container on the nozzle moves downwardly as it is filled against the bias of the spring 95 and, when the container reaches a preselected lowered position, the position sensing switch 102 is actuated to index the transfer mechanism. In accordance with the present invention, the position sensing switch 102 is adjusted so as to be actuated when the container reaches a position in which its upper edge is adjacent the level of the lower edge portion 21*a* of the nozzle and is spaced below the lower edge portion 21*b* of the nozzle. The relative vertical position of the container and nozzle is controlled during movement of the container crosswise of the nozzle so that the upper edge of the container is initially at a level below the outlet edge of the nozzle to shear off material in the container at a level above the upper edge of the container and the container is thereafter raised during continued movement crosswise of the nozzle to cause the trailing edge of the container to substantially wipe across the lower edge portion 21*b* of the nozzle at the trailing side of the latter. In the embodiment of FIGS. 1–9, raising of the container during movement across the nozzle is controlled by a ramp 111. In the embodiment of FIGS. 10–12, raising of the container as it is moved across the nozzle is controlled by a second elevator 121' operated in timed relation with the movement of the container transfer mechanism.

The embodiments of the invention in which an exclusive property or privilege is claimed are defined as follows:

1. A method of filling open-top containers with flowable semi-solid material comprising, flowing a semi-solid material in continuous fashion through a downwardly opening nozzle, the nozzle having a lower edge portion at one side thereof defining a material shear edge for shearing the semi-solid material in the container from the semi-solid material in the nozzle, advancing an empty container along a container infeed path to a filling station below the nozzle, elevating the container at the filling station into at least partial telescoping relation on the nozzle, lowering the container on the nozzle as it is filled until the upper edge of the container is at a level spaced below the material shear edge at said one side of the nozzle, moving the filled container from a position below the nozzle along a filled container discharge path extending across the material shear edge at said one side of the nozzle, the movement of the container along said filled container discharge path producing a material void in the top of container adjacent the side of the container that leads during such movement, controlling the relative vertical position of the nozzle and container during movement of the container across the material shear edge on the nozzle to initially maintain the upper edge of the filled container spaced below at least a portion of the material shear edge on the nozzle to shear off the material at a level above the top of the container and to subsequently move the filled container and nozzle vertically toward each other sufficient to cause the trailing upper edge portion of the filled container to substantially wipe across the material shear edge at said one side of the nozzle, and pressing a cover down onto the open top of the filled container to press the material above the top of the container into the material void in the container.

2. The method of claim 1 wherein controlling the relative vertical position of the container and nozzle is effected by raising the container during a portion of its movement across the nozzle.

3. A method of filling generally cylindrical open-top containers according to claim 2 wherein said raising of the filled container is commenced when the trail edge of the container is adjacent the center of the nozzle.

4. A method of filling generally cylindrical open-top containers according to claim 1 wherein at least a portion of the material shear edge on said one side of the nozzle is at an elevation above the portion of lower edge of the nozzle at the side of the nozzle opposite said one side.

5. The method of filling open top containers with flowable semi-solid material comprising, flowing a semi-solid material in continuous fashion through a downwardly opening nozzle, the nozzle having a first lower edge portion adjacent a first side of the nozzle disposed in a generally horizontal plane and a second lower edge portion adjacent a second side of the nozzle opposite said first side inclined upwardly from said horizontal plane, advancing an empty container along a container infeed path to a filling station below the nozzle, elevating the container at the filling station into at least partial telescoping relation on the nozzle, lowering the container on the nozzle as it is filled until the upper edge of the container is at a level adjacent said first lower edge portion of the nozzle and is spaced below the second lower edge portion of the nozzle at said second side of the nozzle, moving a filled container from a position below the nozzle along a filled container discharge path extending across said second lower edge portion of the nozzle at said second side thereof, controlling the vertical position of the container during its movement across the material shear edge on the nozzle to initially maintain the upper edge of the filled container at a level adjacent the first lower edge portion of the nozzle and to subsequently raise the filled container sufficient to cause the trailing upper edge portion of the container to generally follow the upwardly inclined second lower edge portion of the nozzle, and pressing a cover down onto the open top of the filled container.

6. An apparatus for filling open-top containers with a flowable semi-solid material comprising, means including a downwardly opening nozzle for discharging a stream of semi-solid material in continuous fashion at a filling station, container transfer means for advancing an empty container to a position below the nozzle and for advancing a filled container from a position below the nozzle along a filled container discharge path extending across a portion of the lower edge of the nozzle at one side thereof, the portion of the lower edge of the nozzle at said one side thereof defining a material shear edge for shearing the semi-solid material in the container from the material in the nozzle, the movement of the container along the filled container discharge path producing a material void in the top of the container adjacent the side that leads during such movement, container elevator means for elevating a container at the filling station into at least partial telescoping relation on the nozzle, container position sensing means for sensing when the container on the nozzle moves downwardly to a position in which the upper edge of the container is spaced below at least a portion of said material shear edge on the nozzle, means for controlling the relative vertical position of the filled container and nozzle while the filled container is moved along the filled container discharge path and operative to initially maintain the upper edge of the filled container at a level below at least a portion of the material shear edge on the nozzle to shear off the material at a level above the upper edge of the container and to thereafter move the filled container and nozzle vertically toward each other sufficient to cause the trailing upper edge portion of the filled container to substantially wipe across the material shear edge on said one side of the nozzle, and thereafter pressing a cover down onto the open top of the filled container to press the material above the top of the container into the material void in the container.

7. An apparatus for filling containers according to claim 6 wherein said means for controlling the relative vertical position of the filled container and nozzle during movement along the filled container discharge path includes means operative to raise its filled container during a portion of its movement across the nozzle.

8. An apparatus for filling containers according to claim 6 wherein at least a portion of said material shear edge said one side of the nozzle is at an elevation above the portion of the lower edge of the nozzle at the side of the nozzle opposite said one side.

9. An apparatus for filling containers according to claim 6 wherein the nozzle has a lower edge portion at the side remote from said one side disposed in a generally horizontal plane and said material shear edge is inclined upwardly from that horizontal plane in the direction of movement of the container along the filled container discharge path.

10. An apparatus for filling containers according to claim 6 wherein said means for controlling the relative vertical position of the nozzle and container during movement along the filled container discharge path includes inclined ramp means engageable with the lower end of the filled container as it is moved along the filled container discharge path.

11. An apparatus for filling containers according to claim 6 wherein said means for controlling the relative vertical position of the nozzle and container during movement along the filled container discharge path includes a second container elevator means engageable with the lower end of the filled container as it is moved along the filled container discharge path, and means operated in timed relation with said container transfer means for raising and lowering said second container elevator means.

12. An apparatus for filling open-top containers with a flowable semi-solid material comprising, means including a downwardly opening nozzle for discharging a stream of semi-solid material in continuous fashion at a filling station, container transfer means for advancing an empty container to a position below the nozzle and for advancing a filled container from a position below the nozzle along a filled container discharge path extending across a portion of the lower edge of the nozzle at one side thereof, the portion of the lower edge of the nozzle at said one side thereof defining a material shear edge for shearing the semi-solid material in the container from the material in the nozzle, the movement of the container along the filled container discharge path producing a material void in the top of the container adjacent the side that leads during such movement, container elevator means for elevating a container at the filling station into at least partial telescoping relation on the nozzle, container position sensing means for sensing when the container on the nozzle moves downwardly to a position in which the upper edge of the container is spaced below at least a portion of the material edge on the nozzle, means responsive to said container position sensing means for operating said container transfer means to move a filled container along said filled container discharge path, and container engaging means engageable with the underside of the container operative during an initial portion of the movement of the container along said filled container discharge path to maintain the upper edge of the container at a level below at least a portion of said material shear edge on the nozzle and operative after the container has moved part way across the lower end of the nozzle for raising the filled container sufficient to cause its upper edge at the side that trails during such movement to substantially wipe across the material shear edge on said one side of the nozzle, and means for pressing a cover onto the open top of the filled container to press the additional material into the material void in the top of the container.

13. An apparatus for filling containers according to claim 12 wherein said container engaging means includes an inclined ramp engageable with the underside of the filled container as it is moved along the filled container discharge path.

14. An apparatus for filling containers according to claim 12 wherein said container engaging means includes a second container elevator means engageable with the underside of the filled container as it is moved along the filled container discharge path, and means operated in timed relation with said container transfer means for raising and lowering said second container elevator means.

15. An apparatus for filling open-top containers with a flowable semi-solid material comprising, means including a downwardly opening nozzle for discharging a stream of semi-solid material in continuous fashion at a filling station, container transfer means for advancing an empty container to a position below the nozzle and for advancing a filled container from a position below the nozzle along a filled container discharge path extending across a portion of the lower edge of the nozzle at one side thereof, the portion of the lower edge of the nozzle at said one side thereof defining a material shear edge for shearing the semi-solid material in the container from the material in the nozzle, the nozzle having a generally horizontal lower edge portion at the side remote from said one side of the nozzle, said material shear edge being inclined upwardly from the plane of said generally horizontal portion in the direction of movement of the container along the filled container discharge path, container elevator means for elevating a container at the filling station into at least partial telescoping relation on the nozzle, container position sensing means for sensing when the container on the nozzle moves downwardly to a position in which the upper edge of the container is adjacent the level of said generally horizontal lower edge portion on the nozzle and is spaced below at least a portion of said material shear edge on the nozzle, means responsive to said container position sensing means for operating said container transfer means to move a filled container along said filled container discharge path, means for controlling the vertical position of the container as it is moved along the filled container discharge path operative to initially maintain the upper edge of the filled container at a level below at least a portion of said material shear edge at said one side of the nozzle to shear off the material at a level above the upper edge of the container and to thereafter raise the filled container sufficient to cause the trailing upper edge of the filled container to substantially follow and wipe across the upwardly inclined material shear edge on the nozzle, and means for closing the open top of the filled container.

16. An apparatus for filling open-top containers according to claim 15 wherein said material shear edge is inclined upwardly from adjacent the center of the nozzle.

* * * * *

UNITED STATES PATENT AND TRADEMARK OFFICE

CERTIFICATE OF CORRECTION

PATENT NO. : 4,388,795

DATED : June 21, 1983

INVENTOR(S) : Roger H. Stohlquist et al

It is certified that error appears in the above-identified patent and that said Letters Patent are hereby corrected as shown below:

Column 11, line 16, after "edge" insert -- at --.

Signed and Sealed this

*Thirteenth* Day of *September 1983*

[SEAL]

*Attest:*

GERALD J. MOSSINGHOFF

*Attesting Officer*

*Commissioner of Patents and Trademarks*